US007404306B2

(12) United States Patent
Walls et al.

(10) Patent No.: US 7,404,306 B2
(45) Date of Patent: Jul. 29, 2008

(54) MULTI-POINT DOOR LOCK AND OFFSET EXTENSION BOLT ASSEMBLY

(75) Inventors: Christopher G. Walls, Rockford, IL (US); Lyle Edward Hansel, Hobart, IN (US)

(73) Assignee: Newell Operating Company, Atlanta, GA (US)

( * ) Notice: Subject to any disclaimer, the term of this patent is extended or adjusted under 35 U.S.C. 154(b) by 97 days.

(21) Appl. No.: 10/767,472

(22) Filed: Jan. 29, 2004

(65) Prior Publication Data

US 2005/0166647 A1 Aug. 4, 2005

(51) Int. Cl.
*E05B 59/00* (2006.01)

(52) U.S. Cl. ..... 70/107; 70/451; 70/461; 70/466; 292/DIG. 53; 292/35; 292/139

(58) Field of Classification Search ..... 70/107–109, 70/118–120, 129, 130, 134, 451, 461, 466; 292/32, 34–36, 39, 142, 156, 158, 160, 161, 292/138, 139, DIG. 53, DIG. 54
See application file for complete search history.

(56) References Cited

U.S. PATENT DOCUMENTS 508,635 A * 11/1893 Reeves ..... 292/36
654,579 A * 7/1900 Ericson ..... 292/147
928,904 A * 7/1909 Cottrel ..... 70/71
1,094,143 A * 4/1914 Hagstrom ..... 70/118
1,311,598 A * 7/1919 Fink ..... 292/7
2,787,154 A * 4/1957 Wesberry ..... 70/118
2,886,960 A * 5/1959 Willett et al. ..... 70/92
3,086,383 A * 4/1963 Scott ..... 70/156
3,680,901 A 8/1972 Biebuyck
3,697,105 A 10/1972 Marx
3,771,339 A * 11/1973 Smith ..... 70/118
3,811,717 A 5/1974 Floyd et al.
4,315,648 A * 2/1982 Labelle ..... 292/150
4,362,328 A * 12/1982 Tacheny et al. ..... 292/36
4,368,905 A * 1/1983 Hirschbein ..... 292/5
4,500,122 A 2/1985 Douglas
4,617,775 A * 10/1986 Padrun ..... 52/684
4,643,005 A 2/1987 Logas
4,648,639 A 3/1987 Martin et al.
4,674,776 A 6/1987 James
4,754,624 A 7/1988 Fleming et al.
4,861,078 A 8/1989 Munoz
4,865,367 A 9/1989 Choi
4,907,908 A * 3/1990 Gerhard ..... 403/393
4,973,091 A 11/1990 Paulson et al.

(Continued)

*Primary Examiner*—Suzanne D Barrett
(74) *Attorney, Agent, or Firm*—Banner & Witcoff, Ltd.

(57) ABSTRACT

A multi-point door lock assembly has a central lock and an extension bolt for securing the door to a door frame. The assembly has an actuator positioned at the central lock and moveable between a first and second position along an axis. The assembly further has an elongated extension bolt residing along a bolt axis. The actuator and the bolt are secured in a configuration that displaces the axis of the bolt in spaced relationship from the axis of the actuator by an adaptor having a body length. The adaptor has a first end connected to the actuator and a second end connected to the extension bolt, and an intermediate portion between the first and second ends configured to displace the bolt axis for the bolt to pass through an interior portion of an associated door member.

12 Claims, 5 Drawing Sheets

U.S. PATENT DOCUMENTS 4,974,886 A 12/1990 Kleefeldt et al.
5,042,851 A * 8/1991 Hunt ..... 292/21
5,074,133 A * 12/1991 Simoncelli ..... 70/90
5,096,237 A 3/1992 Hötzl
5,102,174 A * 4/1992 Prevot ..... 292/336.3
5,120,094 A 6/1992 Eaton et al.
5,290,077 A 3/1994 Fleming
5,371,991 A * 12/1994 Bechtel et al. ..... 52/686
5,388,875 A 2/1995 Fleming
5,394,718 A 3/1995 Hötzl
5,404,737 A 4/1995 Hötzl
5,419,597 A 5/1995 Brackmann et al.
5,440,103 A 8/1995 Martin
5,492,382 A 2/1996 McBride et al.
5,495,731 A 3/1996 Riznik
5,498,038 A * 3/1996 Simon et al. ..... 292/36
5,660,420 A * 8/1997 Smith et al. ..... 292/3
5,676,003 A 10/1997 Ursel et al.
5,722,704 A 3/1998 Chaput et al.
5,782,114 A * 7/1998 Zeus et al. ..... 70/109
5,820,170 A 10/1998 Clancy
5,820,177 A 10/1998 Moon
5,822,926 A * 10/1998 Koike et al. ..... 49/394
5,873,274 A 2/1999 Sauerland
5,878,605 A 3/1999 Renz
5,906,403 A 5/1999 Bestler et al.
5,911,763 A * 6/1999 Quesada ..... 70/120
6,007,115 A 12/1999 Roth
6,048,000 A 4/2000 Geringer et al.
6,209,364 B1 4/2001 Collet et al.
6,209,931 B1 4/2001 Von Stoutenborough et al.
6,217,087 B1 * 4/2001 Fuller ..... 292/39
6,357,803 B1 3/2002 Lorek
6,375,244 B1 * 4/2002 Smeltzer ..... 292/36
6,378,916 B1 * 4/2002 Huang ..... 292/27
6,415,565 B1 * 7/2002 Sosa ..... 52/207
6,508,087 B2 * 1/2003 Lemley et al. ..... 70/56
6,539,755 B1 4/2003 Bruwer et al.
7,013,688 B2 * 3/2006 Chen ..... 70/107
2005/0229657 A1 * 10/2005 Johansson et al. ..... 70/107

* cited by examiner

MULTI-POINT DOOR LOCK AND OFFSET EXTENSION BOLT ASSEMBLY

FIELD OF THE INVENTION

The present invention relates to a door lock and bolt assembly. More specifically, the present invention relates to a multi-point door lock extension bolt assembly with an adaptor enabling at least an extent of the extension bolt to be offset relative the lock mechanism and to be concealed within the door.

BACKGROUND OF THE INVENTION

Multi-point door lock systems used in connection with door assemblies are generally known in the art. Conventional multi-point lock systems are generally used in sliding door, swinging door and/or french door assemblies. Typical multi-point door lock systems include latch or bolt assemblies that extend from the lock unit to engage the door frame, thus enabling the door to be securely locked to the frame. Plural latches or bolts are used to provide added security by locking the door to the frame at a plurality of locations. For example, typical multi-point locking door assemblies include a central lock mechanism that controls a central latch, as well as at least one bolt mechanism that engages the door frame above or below the door. The bolt mechanism of such multi-point door locks has an elongated body that extends from the central lock mechanism to the door frame, typically in the form of an elongated extension bolt. For added security, most of such multi-point locking doors have extension bolts extending from the central lock to both the top frame, and the floor threshold or bottom frame member. The extension bolts of such devices are positioned along an edge of the door, or are located in a channel or other passageway within the door.

Example of these types of prior art assemblies are shown in FIGS. 1 and 2. FIG. 1 shows a door with a multi-point locking system that has an extension bolt extending from the central lock unit and exposed along an edge of the door member of the assembly. The edge faces outwardly towards the frame. This type of multi-point locking assembly, thereby has extension bolts passing along the outer edge of the door, usually along the edge that first separates from the doorjamb during opening of the door. In the embodiment, the door edge may be slightly recessed to accommodate flush installation of the extension bolts. FIG. 2 depicts an example of an alternative structure of a typical multi-point lock assembly. FIG. 2 shows a multi-point lock assembly in which the extension bolts extend through an internal channel of the door, to engage the door frame at the top and/or bottom of the door. This type of door lock assembly, with an extension bolt passing through the body of the door, provides a locking bolt structure that is spaced inward of the door edge and is thereby concealed within the door. Depending on the specific application, this arrangement may provide added security by preventing tampering; and it provides a cleaner appearance with less exposed mechanical parts.

Each of these types of multi-point lock assemblies offer benefits that may make one preferred for use in a given situation. For example, there may be applications in which added security would be achieved by providing extension bolts that pass through the body of the door, rather than being exposed along an edge. Alternatively, it may be preferable to have the extension bolts located along the edge of the door, such as may be desired for ease of installation or replacement of an existing type of assembly and to mate with existing recesses in the door frame. It is understood that the central lock units of the lock assemblies of FIGS. 1 and 2 have different structural configurations to accommodate the different structural configurations of the extension bolts. Each central lock unit is specific for its particular extension bolt configuration. Because of such needs, it would be beneficial to have available a lock assembly that may be adapted for use, capable of modification to accommodate either structure of an extension bolt.

Therefore, it is desirable to provide a multi-point locking assembly capable of such adaptation by a user, and that is suitable for alternate positioning the passage of extension bolts, or similar extension bolt members, relative the central locking mechanism. Further, it is desirable to provide an adaptable extension bolt assembly that is capable of being mounted to a central lock device configured for an extension bolt such as is shown in FIG. 1, and yet with an altered alignment to permit passage of the bolts inside the door such as is shown in FIG. 2. The present invention is provided to solve these as well as other needs.

SUMMARY OF THE INVENTION

The present invention provides a locking door assembly having a door member mounted to a door frame and moveable between at least an open and closed position, with a lock assembly having a central lock member positioned in the door member. The lock assembly has at least one actuator member connected to the central lock that is moveable along an axis of extension between a first position and second position. The assembly further has an extension bolt with an elongated body extending along a bolt axis, and a proximal end connected to the actuator member and a distal end with a projection configured to mate with a receiver for locking the door in position. The connection of the actuator and the extension bolt includes an adaptor body with an intermediate length extending transverse to the extension bolt axis. This arrangement defines an extent of separation of the extension bolt axis from the actuator axis.

The present invention also provides a multi-point lock assembly as described above, that is configured to be mounted in a door to provide a central lock assembly with an actuator moveable along an axis of movement, and an extension bolt with an elongated body axis. The actuator is secured to the extension bolt by an adaptor having a length that extends transverse the elongated bolt axis, thus placing the extension bolt axis a distance away from the actuator axis. The present invention further provides a lock assembly in which the connection of the extension bolt to the actuator is configured for alternate connection by a user. In a first configuration, the bolt and actuator are connected in linear relationship such that the axis of the extension bolt is in substantial alignment with the actuator axis. In a second configuration, the the adaptor length is transverse to the bolt axis to separate the actuator axis a distance from the bolt axis.

The present invention further provides an adaptor for connecting an extension bolt to a central lock device of a multi-point lock assembly for a door. The adaptor has an adaptor body with a first end connected to a mating portion of the lock actuator member, and a second end connected to the elongated extension bolt. The adaptor has a body length, extending between the first end and the second end, which extends transverse to the elongated extension bolt. In this manner, the adaptor may be connected to the structure of a multi-point lock assembly to displace the extension bolt into alignment with an internal passageway through the associated door, spaced away from the edge of the door.

Other advantages and aspects of the present invention will become apparent upon reading the following description of the drawings and detailed description of the invention

BRIEF DESCRIPTION OF THE DRAWINGS

In accompanying drawings, in which like numerals are employed to designate like parts throughout the same.

DETAILED DESCRIPTION OF THE DRAWINGS

Figure 2:
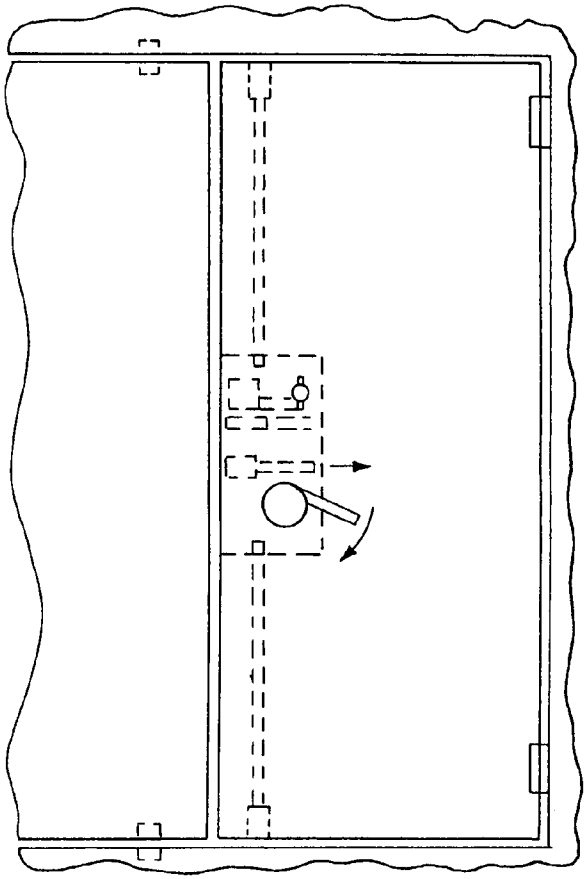
FIG. 2 PRIOR ART
FIG. 2 is a partial elevational view of a prior art door and multi-point lock assembly having a concealed extension bolt assembly extending in a channel within the body of the door.

While this invention is susceptible of embodiments of many different forms, there is shown in the drawings and will herein be described in detail preferred embodiments of the invention, with the understanding that the present disclosure is considered to be an exemplification of the principles of the invention and is not intended to limit the broad aspect of the invention to the embodiments illustrated.

Figure 3:
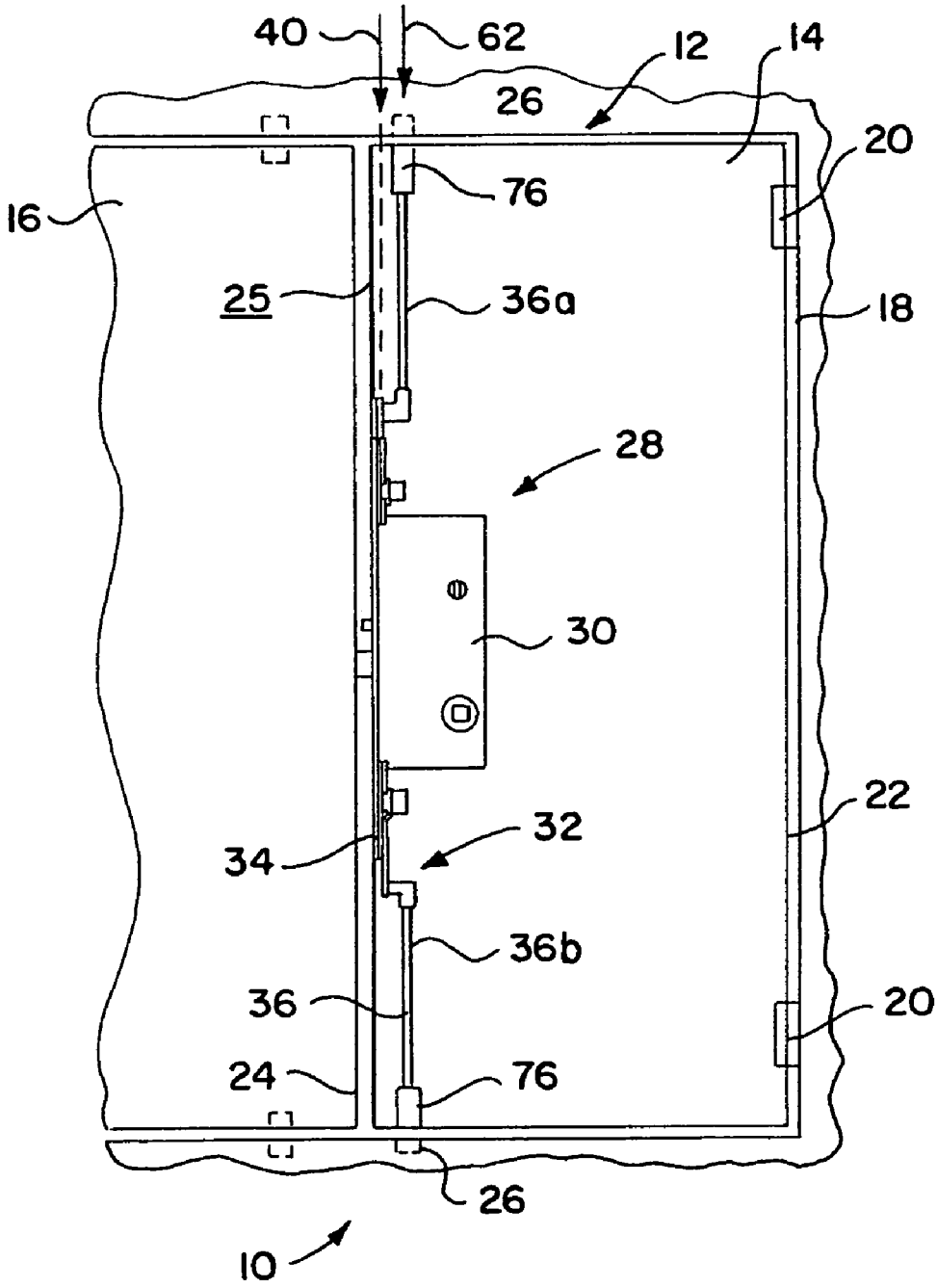
FIG. 3 is an elevational view of a door assembly and multi-point lock assembly in accordance with the present invention.

Referring now to FIG. 3, there is shown a multi-point door locking assembly 10 of the present invention. The door lock assembly 10 is shown operatively connected to a conventional swinging door assembly 12. The door assembly 12 comprises a primary door member 14 or movable member, mounted within a master door frame 18. The primary door 14 is mounted by conventional means to provide reciprocal sliding and/or swinging movement within the door frame 18, thereby enabling ingress and egress through the door assembly 12. Such conventional mountings include hinge connections 20 along a jamb edge 22 of the door 14, or cooperative sliding track arrangement (not shown) between the frame 18 and the door member 14. In the embodiment shown, secondary door member 16 is also mounted to the door frame 18, and is located adjacent the lock edge 24 of the door, opposite the doorjamb edge 22. The secondary door 16 also may be a movable door member capable of sliding and/or swinging within the door frame 18, and having a locking assembly 10 as is depicted in the primary door member 14, or some other locking structure. Alternatively, the door member is mounted without the use of a secondary door member 16, such that a portion of the door frame is located adjacent the lock edge 24 of the door 14. The multi-point door locking system 10 of this invention is operatively connected to the door assembly 12, for enabling the door member 14 to be securely locked to the door frame 18. In the present embodiment, the locking system 10 is connected to the primary door member 14. It is also contemplated that the locking system 10 may be connected to the second door member 16, if desired, without departing from the scope of the present invention. Therefore, use of the term door frame may be used in reference to any adjacent structure suitable for securement of the door, including a door frame jamb 18 or an adjacent door structure 16.

The door frame 18 preferably has one or more lock bolt receivers 26 integral with the door frame 12 for receiving a bolt projection of the assembly for locking the door in a selected position. In the embodiment shown in FIG. 3, there is a top and bottom receiver 26, each for receiving a respective bolt projection of the lock assembly 28. The lock assembly 28 includes a central lock body 30 with at least one extension bolt assembly 32. The extension bolt assembly 32 preferably includes an actuator member or actuator arm 34 and a connected extension bolt member 36.

The body 30 of the central lock assembly 28 has an internal mechanism 38 configured for manipulation by a user to lock and unlock the door member 14 relative the door frame 18. Manipulation of the central lock assembly, and resulting interface movement of the internal mechanism 38, causes movement of the actuator arm 34 extending from the central lock body 30. Such manipulation causes movement of the actuator 34 between a first position located close to the central lock body 30, and a second position that is extended a distance further from the central lock body 30. In the preferred embodiment, the actuator arm 34 moves between the first and second position along an axis of movement 40 (FIG. 5).

Figure 4:
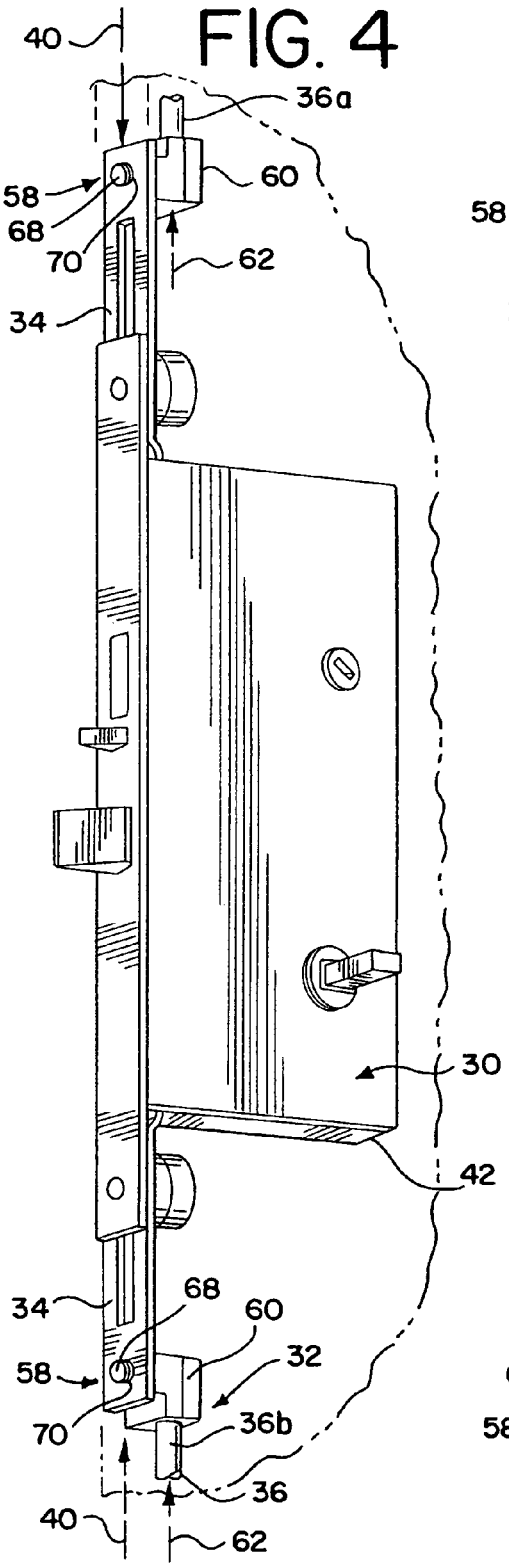
FIG. 4 is a partial perspective view of the multi-point door lock assembly of FIG. 3.
Figure 5:
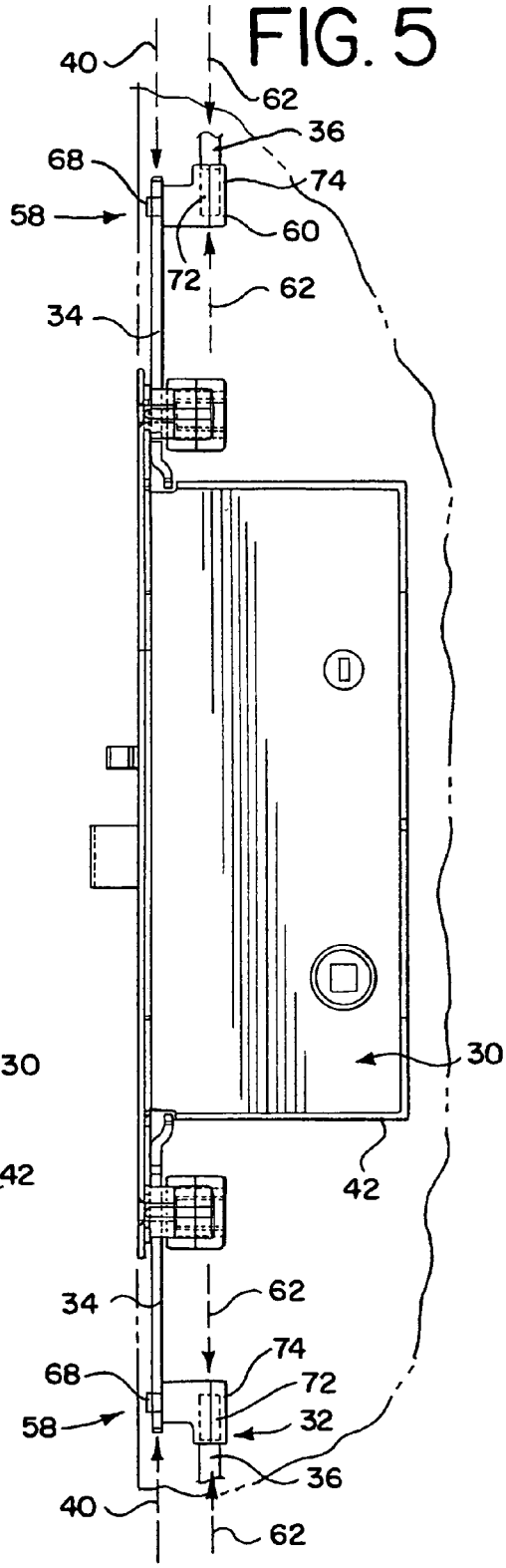
FIG. 5 is a partial elevational view of the multi-point door lock assembly of FIG. 3.
Figure 6:
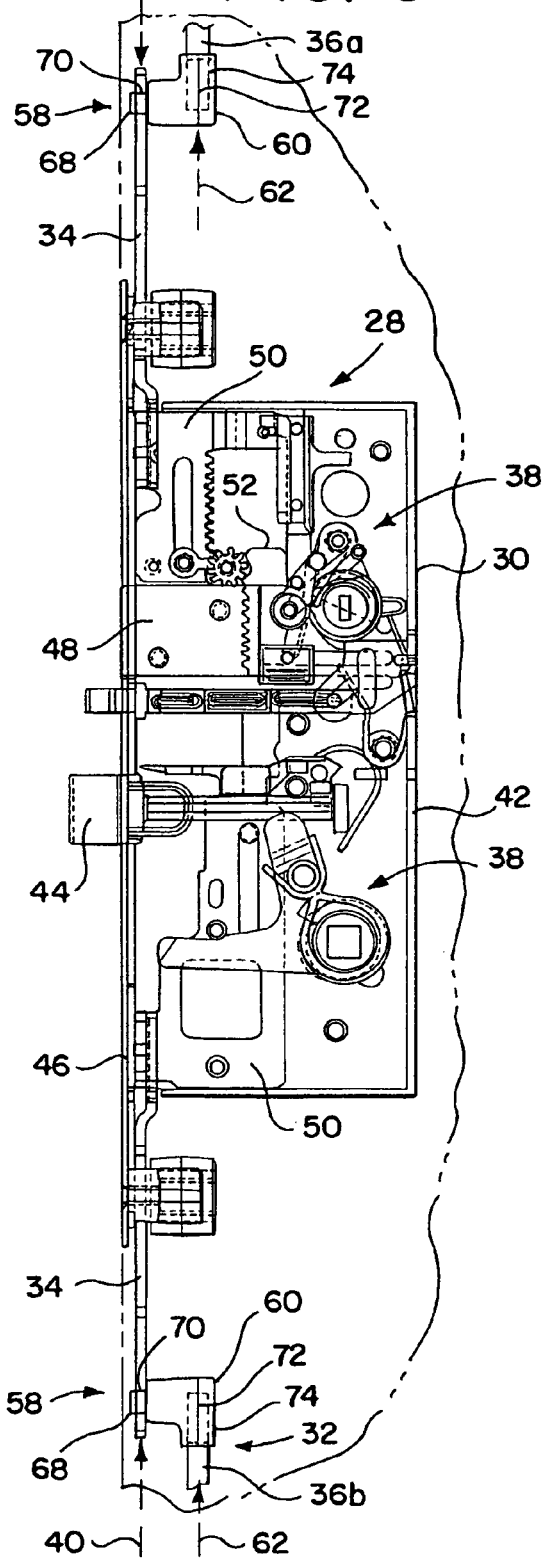
FIG. 6 is a partial sectional view of the assembly if FIG. 5, with the interior of the central lock assembly in view and connections of bolt components shown in broken lines.
Figure 7:
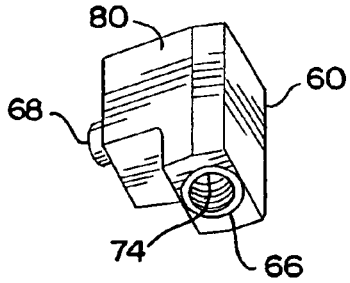
FIG. 7 is a perspective view of the adaptor of the present invention.
Figure 8:
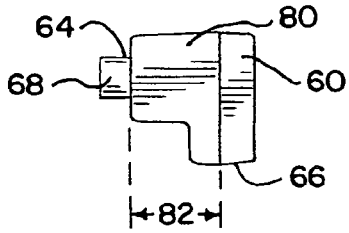
FIG. 8 is a side view of the adaptor of the present invention.
Figure 9:
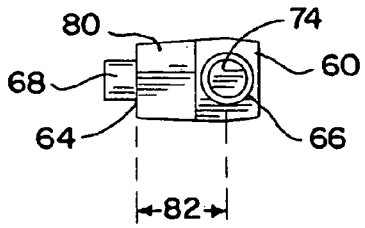
FIG. 9 is a top view of the adaptor of the present invention.

As shown in FIGS. 4-6, the central lock body 30 includes a housing 42 providing a compartment for the internal mechanism 38, and the actuator arm 34 preferably extends from the housing 42 at the lock edge 24 of the door 14. In the preferred form of the invention, the multi-point lock arrangement includes a latch member 44 extending from the face plate 46 that extends along the lock edge 24 of the door 14. The face plate 46 is preferably formed of flat sheet stock material such as metal, mounted directly to the outer surface 25 of the door edge 24, and is thereby exposed along the lock edge 24 of the door 14.

The lock assembly preferably includes a deadbolt member 48 that may be deployed to an extended position protruding from the face plate 46 to engage an associated portion of the door frame 18, thereby providing one of the points of the multi-point locking arrangement. The lock assembly internal mechanism 38 is configured to be manipulated by a user to control locking engagement between the door member 14 and the door frame 18, by controlling movement of the latch member 44, the dead bolt member 48, and each extension bolt assembly 32. As shown in FIG. 6, the mechanism 38 of the central lock assembly 28 preferably includes at least one slide member 50 and an associated drive assembly 52. The drive assembly 52 is operably connected to the slide member 50 to provide control of each actuator 34, to move the actuator 34 between the first and second positions. This arrangement thereby provides operational connection of the drive assembly 52 to each extension bolt assembly 32, through manipulation of each actuator arm 34. Further details of components and operation of a suitable lock mechanism for use with this invention, such as that which is depicted in the Figures, is described in U.S. Pat. No. 6,209,931, entitled, "Multi-Point Door Locking System," which has been assigned to the assignee of the present application, and incorporated herein by reference. Further details of components and operation of another suitable lock mechanism for use with this invention, such as that which is depicted in the Figures, is described in U.S. patent application Ser. No. 10/107,518, entitled "Multi-point Lock Assembly," which has been assigned to the assignee of the present application, and incorporated herein by reference.

As further shown in FIGS. 3-9, the connection 58 of the actuator arm 34 to the extension bolt member 36 according to the present invention includes an adaptor 60 that provides structure for displacing the extension bolt axis 62. More specifically, the adaptor 60 has a first end 64 connected to the actuator arm 34 and a second end 66 connected to the extension bolt member 36. In the preferred form of the invention, the first end 64 of the adaptor 60 has a projection 68 dimensioned to be received in mating arrangement with a receiver 70 of the actuator arm 34. The mating arrangement of the projection 68 into the receiver 70 provides connection of the adaptor 60 to the actuator 34 by a friction fit at the first end of the adaptor 60. This connection may also include engagement or locking with a mechanical fastener, such as a retaining washer or threaded fastener arrangement (not shown), without departing from the structural benefits of the present invention.

The second end 66 of the adaptor 60 is configured for secure connection with the extension bolt member 36. The connection of these components includes a mating arrangement of a second projection 72 and a second receiver 74. In the embodiment shown in the figures, the second receiver 74 is formed as part of the adaptor 60, and the mating second projection 72 is formed as part of the extension bolt member 36. However, this arrangement may be reversed while still practicing the invention. In this manner, the second projection is optionally formed as part of the adaptor 60, either with or without threading, and the second receiver may be formed as part of the extension member 36. This mating arrangement between the adaptor 60 and the extension member 36, either through friction fit or mechanical fastening, provides a connection that securely joins the adaptor 60 such that movement of the adaptor 60 by manipulation of the actuator arm 34 will transfer force of movement to the extension member 36. In other words, movement of the actuator arm 34 from the first position to the second position (described above) causes the adaptor 60 to move away from the central lock body 30, and thereby causes the extension member 36 to move along the axis 62 of the member 36. Movement of the extension member 36 thereby results in deployment of the bolt projection 76 located at the distal end of the extension member, whereby the bolt projection is inserted into a receiver 26 of the door frame 18.

One benefit of having a such an assembly with an adaptor 60 is that it provides structure to position the extension bolt 36 in the interior of the door member 14, while maintaining use of the actuator arm 34 located along the lock edge 24 of the door 14. This is achieved by altering the position of the movement axis 40 of the actuator arm 34 separate from the axis 62 of the extension bolt 36. As is shown in the Figures, such displacement of the bolt axis 62 from the actuator axis 40 is provided by the adaptor 60 having a body 80 with a body length 82 extending between the first end 64 and the second end 66. Because the body length 82 passes transverse the actuator axis 40 and the extension bolt axis 62, the extent of the body length 82 defines the extent of displacement of the two axes 40,62. In the preferred embodiment, the body length 82 is a fixed length between the mounting of the actuator 34 at the first end 64 and the mounting of the extension bolt 36 at the second end 66. Accordingly, the body length 82 is preferably constant and defined by the extent of the adaptor body 80; and, therefore, does not include an extent of threading or similar such structure that would vary the extent of the length 82 such as by tightening a threaded arrangement. In an alternate embodiment (not shown), in which the length 82 may be adjusted to provide adjustable displacement of connection 58, it is preferable for no portion of the length 82 being formed of threaded arrangement of connecting the adaptor 60 to either the actuator 34 or the extension bolt member 36. It is understood that the body length 82 could have non-transverse configurations, such as diagonal configuration, that still provides displacement, or an offset of the two axes 40,62.

Figure 1:
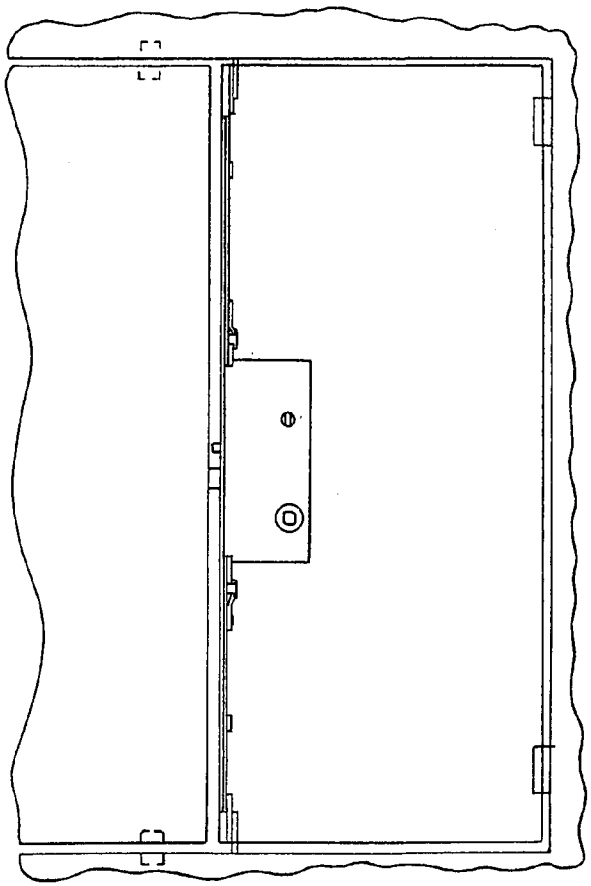
FIG. 1 PRIOR ART
FIG. 1 is a partial elevational view of a prior art door and multi-point lock assembly having an extension bolt assembly positioned along the edge of the door.

In another embodiment of the invention, the assembly 10 includes a lock assembly 28 with structure that is adaptable between a first configuration (FIG. 1) whereby the axis of the extension bolt is in substantial alignment with the actuator axis (such as with that of prior art assemblies as shown in FIG. 1), and a second configuration (FIG. 3) whereby the axis 62 of the extension bolt 36 resides a distance away from the actuator axis 40. Such alternating configuration is provided by a structure that allows optional use of the adaptor 60 as part of the connection 58 between the actuator 34 and the extension bolt member 36. If the user elects to have the extension bolt member 36 located along the lock edge 24 of the door 14, then the user links the connection 58 of the actuator 34 to the extension bolt 36 without the use of an adaptor having a length transverse either axis 40,62. Alternatively, if the user elects to configure the assembly 10 for an extent of extension bolt(s) 36 to pass through an interior portion of the door 14, spaced from the lock edge 24, then the connection 58 includes the adaptor 60 with the transverse length 82. With such possible configurations, a single central lock unit, such as shown in FIG. 1 or 3-6, can be used in an extension bolt configuration positioned at an edge of the door, or a concealed extension bolt configuration.

As shown in the Figures, the preferred embodiment of the invention includes an assembly with at least two extension bolt assemblies 32, one above and one below the central lock 28 assembly. The top extension member 36*a* extends through the door 14 to engage a top receiver of the door frame 18, and the lower extension member 36*b* extends through the door 14 to engage with a receiver in the frame 18 below the door 14. Extension bolt members 36 may be provided in a variety of lengths to accommodate different doors or applications, and may be engaged for locking by structure differing from the traditional bolt projection structure, such as by use of hooks or other locking elements or mechanisms for securement to the frame 18.

Figure 10:
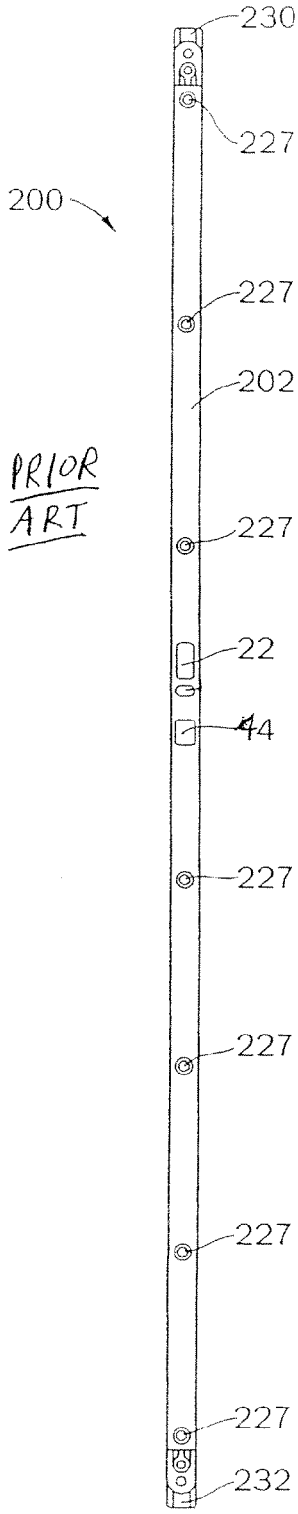
FIG. 10 is a front elevation view of a face plate embodiment of a multi-point door lock assembly.
Figure 11:
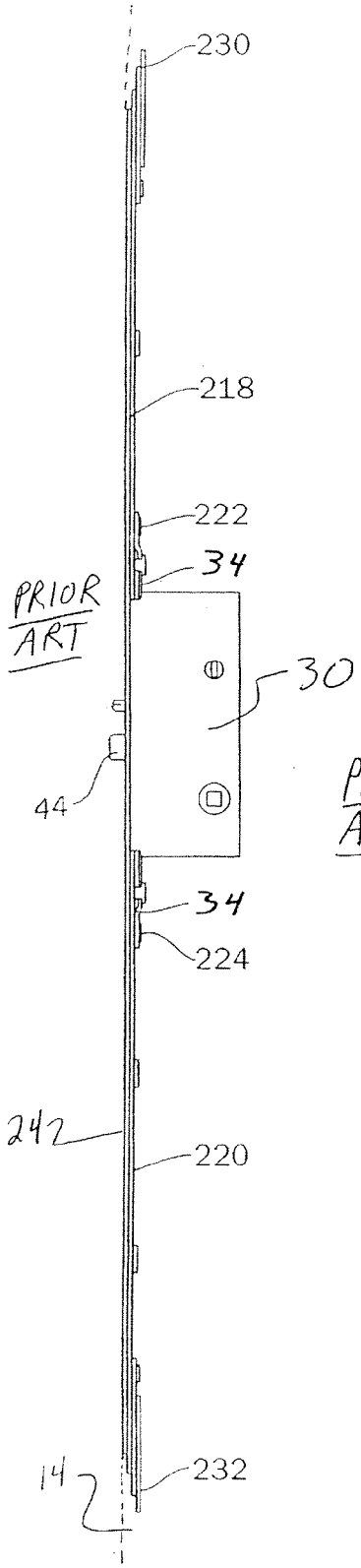
FIG. 11 is a side elevation view of the face plate embodiment of the multi-point door lock assembly of FIG. 10.
Figure 12:
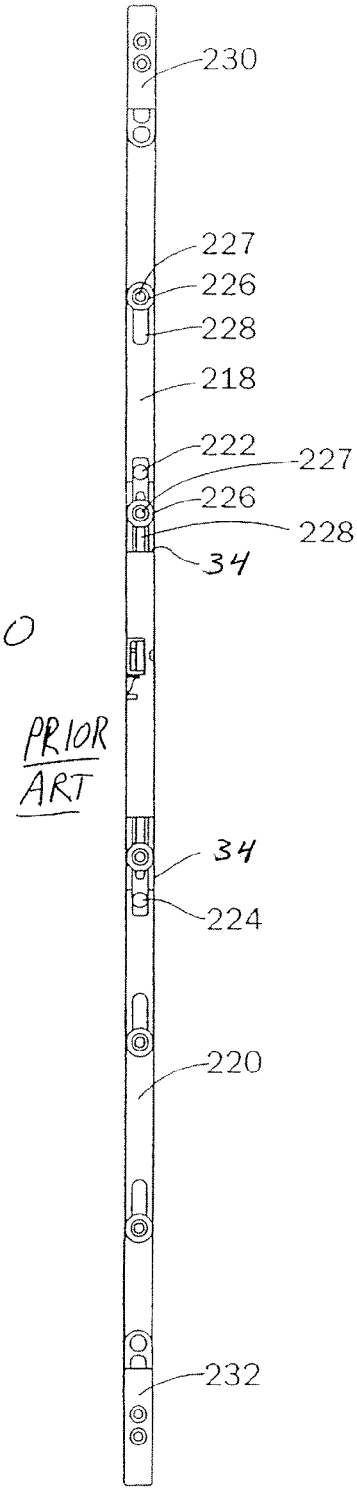
FIG. 12 is a rear elevation view of the face plate embodiment of the multi-point door lock assembly of FIG. 10.

In another configuration, the extension bolts may be installed to extend along a lock edge 24 of a door 14, as depicted in FIGS. 10-12, and similar to the embodiment illustrated in FIG. 1. In this configuration, the actuators 34 are connected to an extension bolt 218,220, each extending along a bolt axis, and the axis of each actuator 34 is in alignment with the bolt axis of each bolt 218,220. As depicted in FIGS. 10-12, an actuator 34 extends through a top slot in housing 228. Similarly, an actuator 34 extends through a bottom slot in housing 228. Each actuator 34 is coupled to slide plate which is actuated by the internal mechanism of the central lock body 30. As the internal mechanism is turned in the counterclockwise direction, actuators are extended from housing 228, similarly to the other embodiments described herein. As depicted in FIGS. 11-12, actuators 34 are coupled to extension bolts 218 and 220 respectively by pins 222 and 224 respectively. A series of spacer guides 226 have columnar pins 227, running therethrough; the spacer guides 226 ride in elongated slots 228. Columnar pins 222 may be provided by, for example, appropriate fasteners such as but not limited to bolts, rivets, nails, or screws. Extension bolts 218 and 220 each have extension bolt tips 230 and 232 respectively. Extension bolt tips 230 and 232 extend into the door frame to securely latch door 14 to a door frame, such as the door and door frame as depicted in FIG. 1. FIG. 10 depicts face plate system 200 having a face plate 202. Face plate 202 runs along the lock edge 24 of door 14.

To install face plate system 200 on a door such as door 14, an operator would form a mortise hole in door 14 having a size and shape that would accommodate insertion of the lock unit 30 therein. Also, an operator would provide a routed groove along edge 24 of door 14 that would accommodate the face plate system 200 such that face plate 202 would reside substantially flush with edge 24 of door 14. When face plate assembly 200 is properly positioned, a plurality of pins 227 (or suitable fasteners) may be used to affix assembly 200 to edge 24 of door 14. Pins 227 would extend into edge 24 of door 14 to fasten assembly 200 thereto. It should be noted that extension bolts 218 and 220 may be provided in a variety of lengths to accommodate different door sizes. Further, it should also be noted that a variety of extension bolt tips 230 and 232 may be used with extension bolts 218 and 220 to provide customized output suitable for the application.

In operation, the multi-point locking system 10 controls locking engagement between the door member 14 and the door frame 18. Movement of the internal mechanism 38 causes the slide member 50 to move, and thereby move the actuator arm 34 along its axis 40. Such movement of the actuator 34 forces movement of the extension bolt 36, to force the bolt in and out of engagement with the receiver 26 in the door frame 18. The adaptor 60, being the connection of the actuator 34 to the extension bolt 36, preferably moves with the actuator and the bolt 36, providing solid connection between the bolt and actuator. Alternatively, the adaptor may affect such movement as a fixed component with respective moving parts connected to the actuator and the bolt, without departing from the present invention.

While the specific embodiments have been illustrated and described, slight modifications of the specific embodiments shown herein are readily available, without significantly departing from the spirit of the present invention and the scope of protection provided by the claims.

What is claimed is:

1. A method of assembling a locking door assembly, comprising the steps of:

providing a door member mounted to a door frame and moveable between at least an open position and a closed position;

providing a lock assembly having a central lock member positioned in the door member and an actuator member connected to the central lock member and moveable along an axis of extension between a first position and a second position; and selecting between installing the lock assembly in a first configuration and installing the lock assembly in a second configuration, wherein installing the lock assembly in the first configuration comprises the step of directly connecting to the actuator member a first extension bolt extending along a first bolt axis such that the axis of extension of the actuator is in alignment with the first bolt axis, and installing the lock assembly in the second configuration comprises the steps of connecting an adaptor member to the actuator member, and connecting the adaptor member to a second extension bolt extending along a second bolt axis, the adaptor member spacing the axis of extension of the actuator a distance away from the second bolt axis.

2. A door assembly comprising:

a door mounted within a door frame, wherein the door includes a lock edge and an interior portion spaced from the lock edge and having a channel within the interior portion, the channel extending from adjacent the door frame to proximate a central lock unit;

the central lock unit having a housing mounted within the door, a movable actuator member having a first portion located within the housing and a second portion extending out of the housing adjacent the lock edge, and an internal mechanism contained within the housing and operably connected to the actuator member to move the actuator member along an axis of movement between an extended position and a retracted position;

an extension bolt having an elongated body extending along an extension bolt axis, the extension bolt extending through the channel between the door frame; and an adaptor having a body portion residing between a first end and a second end, the first end of the adaptor directly connected to the actuator member, and the second end of the adaptor directly connected to the extension bolt, wherein the body portion has a length extending generally transverse to the extension bolt axis to displace the extension bolt axis a distance away from the actuator axis.

3. A kit for assembling an adaptable door lock assembly for installation in a door for locking the door to a door frame, the kit comprising:

a central lock unit adapted to be installed in the door, the lock unit having a movable actuator member with an axis of movement between an extended position and a retracted position;

a first extension bolt and a second extension bolt alternately connectable to the actuator; and an adaptor body having a first end and a second end separated by a length, the first end being connectable to the second extension bolt, wherein the first extension bolt is connectable to the actuator such that when the lock assembly is installed in the door, the first extension bolt extends along a first bolt axis in substantial alignment with the axis of movement of the actuator, and wherein the second extension bolt is connectable to the actuator by connecting the second extension bolt to the first end of the adaptor body and connecting the second end of the adaptor body to the actuator, such that when the lock assembly is installed in the door, the second extension bolt extends along a second bolt axis, the adaptor body spacing the second bolt axis a distance away from the axis of movement of the actuator, the length of the adaptor body defining the distance the second bolt axis is spaced from the axis of the actuator.

4. The kit of claim 3, further comprising a handle that is connectable to the central lock unit to adjust the central lock unit between the extended position and the retracted position.

5. The kit of claim 3, wherein the central lock unit further comprises a second movable actuator member with an axis of movement between an extended position and a retracted position, the kit further comprising:

a third extension bolt and a fourth extension bolt alternately connectable to the second actuator; and a second adaptor body having a first end and a second end separated by a length, the first end being connectable to the fourth extension bolt, wherein the third extension bolt is connectable to the second actuator such that when the lock assembly is installed in the door, the third extension bolt extends along a third bolt axis in substantial alignment with the axis of movement of the second actuator, and wherein the fourth extension bolt is connectable to the second actuator by connecting the fourth extension bolt to the first end of the second adaptor body and connecting the second end of the second adaptor body to the second actuator, such that when the lock assembly is installed in the door, the fourth extension bolt extends along a fourth bolt axis, the adaptor body spacing the fourth bolt axis a distance away from the axis of movement of the second actuator, the length of the second adaptor body defining the distance the fourth bolt axis is spaced from the axis of the second actuator.

6. The kit of claim 3, wherein the adaptor is connectable to the actuator by mating connection of a projection with a recess.

7. The kit of claim 3, wherein the adaptor is connectable to the second extension bolt by mating connection of a projection with a receiver.

8. The kit of claim 7 wherein the adaptor is connectable to the extension bolt by insertion of the projection into the receiver in threaded arrangement.

9. The kit of claim 3, wherein the central lock unit further comprises a housing adapted to be installed within the door, the actuator having a first portion located within the housing and a second portion extending out of the housing, and an internal mechanism contained within the housing and operably connected to the actuator to move the actuator along the axis of movement.

10. The kit of claim 3 wherein the central lock unit has an exposed side adapted to be positioned along an edge of the door when the central lock unit is installed in the door, the actuator member located adjacent said exposed side.

11. The kit of claim 10 wherein the first extension bolt is connectable to the actuator such that the first extension bolt is adjacent the exposed side of the lock.

12. The kit of claim 10 wherein the second extension bolt is connectable to the adaptor such that the second extension bolt axis resides a distance away from the exposed side of the lock, and said second bolt axis is adapted to pass through an interior portion of the door.

* * * * *